United States Patent [19]

Collier

[11] 4,450,624

[45] May 29, 1984

[54] METHOD OF FORMING ELECTRICAL CONNECTORS

[75] Inventor: John C. Collier, York, Pa.

[73] Assignee: Burndy Corporation, Norwalk, Conn.

[21] Appl. No.: 373,040

[22] Filed: Apr. 29, 1982

Related U.S. Application Data

[62] Division of Ser. No. 73,861, Sep. 10, 1979, Pat. No. 4,360,969.

[51] Int. Cl.[3] ..... H01R 43/04

[52] U.S. Cl. ..... 29/881

[58] Field of Search ..... 29/828, 857, 881, 883, 29/417, 453, 450, 876, 433; 206/330, 503, 507, 505, 509, 504, 512, 517, 820; 220/23.4, 1.5, 4 C; 222/143; 339/276 SF

[56] References Cited

U.S. PATENT DOCUMENTS

| | | | |
|---|---|---|---|
| 2,483,424 | 10/1949 | Martines | 206/820 X |
| 2,748,452 | 6/1956 | Pierce | 339/276 SF |
| 2,780,243 | 2/1957 | Williams et al. | 206/515 X |
| 2,839,824 | 6/1958 | Berg | 29/417 |
| 2,995,617 | 8/1961 | Maximoff et al. | 29/450 |
| 3,001,564 | 9/1961 | Hopkins | 206/509 X |
| 3,480,299 | 11/1969 | Henderson | 285/4 |
| 3,550,856 | 12/1970 | Wise | 206/820 X |
| 3,987,930 | 10/1976 | Fuson | 206/509 X |
| 4,139,937 | 2/1979 | L'Homme | 29/453 X |

*Primary Examiner*—Howard N. Goldberg
*Assistant Examiner*—Carl J. Arbes
*Attorney, Agent, or Firm*—Buell, Blenko, Ziesenheim & Beck

[57] ABSTRACT

A method of fitting an electrical connector housing to an electrical contact comprises feeding a chain of connector housings linked end to end in the direction of their length towards a fitting station and, at said fitting station, effecting relative lengthwise movement between the leading housing of the chain and a contact in such a direction as to cause the leading housing to be fitted on to the contact.

7 Claims, 7 Drawing Figures

METHOD OF FORMING ELECTRICAL CONNECTORS

This is a division of application Ser. No. 73,861, filed Sept. 10, 1979, now U.S. Pat. No. 4,360,969 issued Nov. 30, 1982.

This invention relates to a method of fitting electrical connector housings to electrical contacts to form an electrical connector.

Present methods have a disadvantage that each housing has to be taken individually and aligned with a contact which is then inserted to form a connector.

According to the present invention an improved method of fitting an electrical connector housing to an electrical contact comprises feeding a chain of connector housings linked end to end in the direction of their length towards a fitting station and at said fitting station, effecting relative lengthwise movement between the leading housing of the chain and a contact in such a direction as to cause the leading housing to be fitted on to the contact.

Preferably, the fitting of successive housings of the chain to separate contacts is effected automatically. Preferably the contact is maintained stationary at the fitting station and the leading housing is applied to the contact. In this case the leading housing of the chain is preferably applied to the contact while the housing is still linked to the chain, and the housing with the contact fitted therein is then unlinked from the leading end of the chain.

Alternatively, each housing in turn may be unlinked from the chain before it is applied to a contact.

Preferably, in the chain of interlinked connector housings one end of one housing of each pair of adjacent housings fits in and is releasably linked to an end of the other housing of said pair of adjacent housings.

In some circumstances, the steps of forming a chain of linked housings and feeding the chain to apparatus by which housings are applied on to contacts or contacts inserted into housings may be carried out in tandem.

Adjacent housings of the chain may be releasably linked by inter-engaging means comprising at least one protuberance, for example a dimple or a rib, on a surface of one end of one of said pair of adjacent housings, which protuberance engages in a corresponding recess in a surface of an end of the other housing of said pair of adjacent housings.

In the case in which the or each protuberance is a rib preferably the corresponding recess is defined by two spaced ribs.

Preferably, the interengaging means comprises two diametrically opposed protuberances, on one of each pair of adjacent housings engaging in two diametrically opposed recesses in the other of said pair of adjacent housings to allow limited pivotal movement between said housings. This allows the chain of interlinked housings to be wound onto a reel.

Alternatively, the interengaging means may comprise an extension at one end of each pair of adjacent housings which engages in an aperture in an end of the other housing of said pair. Preferably, in this case, the extension has a tab and the aperture is defined by flanges so that the tab makes a snap fit with the flanged aperture.

The invention further includes a chain of interlinked electrical connector housings as hereinbefore described.

The invention is further illustrated by a description, by way of example, of four forms of chain of interlinked electrical connector housings for use in the method of the invention, with reference to the accompanying drawings, in which.

Figure 1:
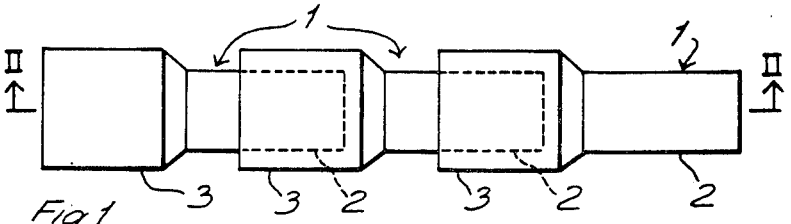
FIG. 1 is a fragmental side-view of the preferred form of chain of interlinked electrical connector housings.
Figure 2:
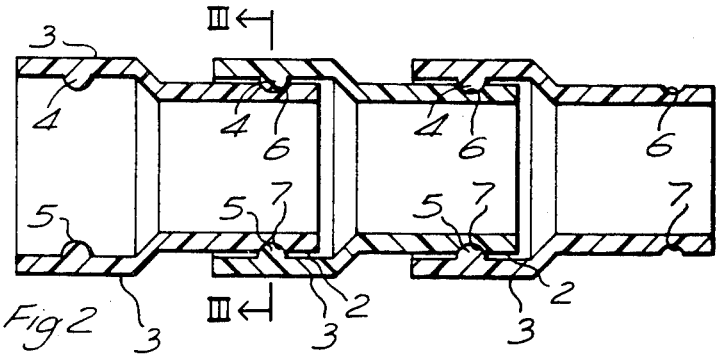
FIG. 2 is a cross-sectional view on the line II—II in FIG. 1.
Figure 3:
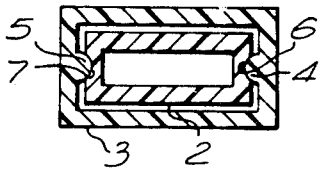
FIG. 3 is a cross-sectional view on the line III—III in FIG. 2.

The electrical connector housing 1 of the chain shown in FIGS. 1 to 3 each have a rectangular cross-section and the outside of one end 2 of each housing fits inside an end 3 of an adjacent housng. Two dimples 4, 5 on the internal surface of the end 3 of each housing 1 engage in corresponding recesses 6,7 in the external surface of the end 2 of an adjacent housing and constitute interengaging means for releasably linking adjacent housings. The dimples 4,5 are positioned on opposite sides of the rectangle to allow limited pivotal movement between interlinked housings.

Figure 4:
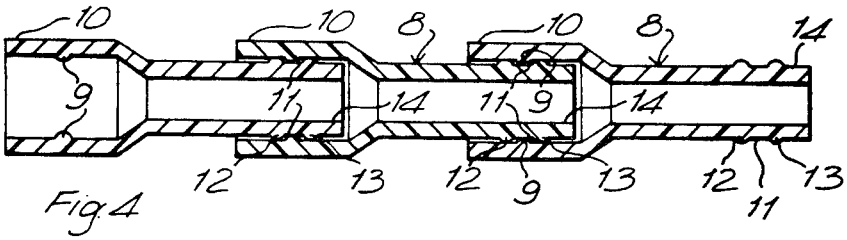
FIG. 4 is a fragmental cross-sectional view of a second form of chain of interlinked electrical connector housings.

The housings 8 of the chain shown in FIG. 4 are similar to those of the chain shown in FIGS. 1 to 3 except that the interengaging means releasably linking adjacent housings is constituted by diametrically opposed ribs 9 on the internal surface of one end 10 of each housing which engage in diametrically opposed recesses 11 defined by ribs 12, 13 on the external surface of an end 14 of an adjacent housing.

Figure 5:
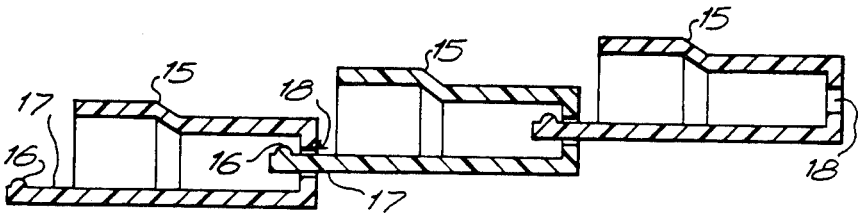
FIG. 5 is a fragmental cross-sectional view of a third form of chain of interlinked electrical connector housings.

The housings 15 of the chain shown in FIG. 5 are interlinked by means of a tab 16 on an extension 17 of one housing which makes a snap fit in a flanged aperture 18 in an adjacent housing.

Figure 6:
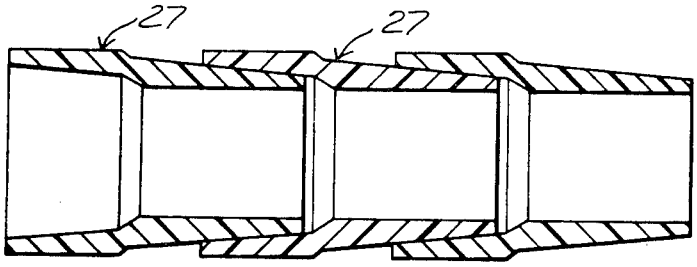
FIG. 6 is a fragmental cross-sectional view of a fourth form of chain of interlinked electrical connector housings.

In the housings 27 of the chain shown in FIG. 6 interengaging shorter sides of the rectangular bores of the interlinked parts of adjoining housings are so tapered that adjacent housings are wedged together. In this case no protuberances and recesses are required.

Figure 7:
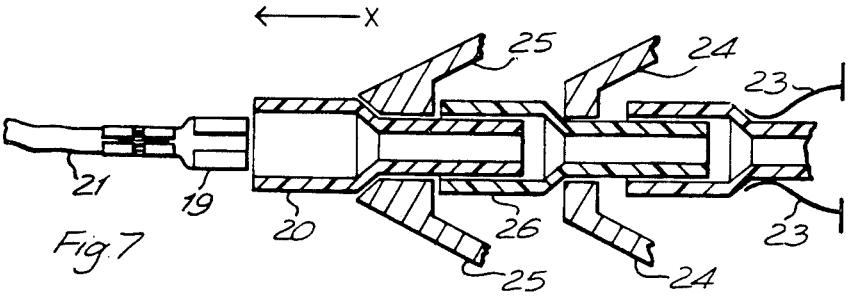
FIG. 7 shows diagrammatically the preferred method of applying the leading housing of a chain of interlinked electrical connector housings, on to an electrical contact.

FIG. 7 shows diagrammatically the preferred method of automatically fitting a contact 19 in a housing 20. The contact 19 is already crimped to an end of a conductor 21 and is held in position at a station to which the chain of housings is fed in the direction of its length. The housing 20 is the leading housing of the chain which is fed through non-return springs 23 and pincers 24 and 25. The pincers 24 and 25 advance the chain in the direction X until the leading housing 20 has been applied over the contact 19 and the contact is locked in position in position inside the housing. The conductor 21 is then pulled in the direction X to separate the leading housing 20, with the contact 19 locked therein, from the chain. The pincers 24 and 25 prevent the next housing of the chain from being separated from the chain. The housing 20 with the contact 19 locked therein is then withdrawn, and the pincers 24 and 25 automatically open and retract to engage the next two housings of the chain ready for repeating the operation.

The housings can be interlocked to form a chain and sold in lengths or in reel form ready for automatic application of the housings or insertion of the contacts.

What I claim as my invention is:

1. A method of fitting an electrical connector housing to an electrical contact comprising forming a chain of connector housings linked end to end, one end of one of each pair of adjacent housings of the chain fitting in and being releasably linked to an end of the other housing of said pair of adjacent housings, feeding said chain in the direction of its length towards a fitting station and, at said fitting station, effecting relative lengthwise movement between the housing nearest the fitting station and at the leading end of the chain and an electrical contact in such a direction as to cause said leading housing to be fitted onto the contact, and effecting release of said leading housing from said chain by moving said leading housing in the direction of the longitudinal axis of said chain, said chain remaining stationary relative to said leading housing.

2. A method as claimed in claim 1, wherein the contact is maintained stationary at the fitting station and the leading housing is applied to said contact.

3. A method as claimed in claim 2, wherein said leading housing of the chain is applied to the contact before said leading housing is released from the chain.

4. A method as claimed in claim 2, wherein said leading housing of the chain is released from the chain before it is applied to a contact.

5. A method as claimed in any one of the preceding claims, comprising forming said chain of connector housing by interlinking interengaging means on said housings, said interengaging means comprising at least one protuberance on a surface of one end of one of each pair of adjacent housings, which protuberance engages a corresponding recess in a surface of an end of the other housing of said pair of adjacent housings.

6. A method as claimed in claim 5, wherein said interengaging means comprises two diametrically opposed protuberances on one of said pair of adjacent housings engaging in two diametrically opposed recesses in the other of said pair of adjacent housings to allow limited pivotal movement between said housings.

7. A method as claimed in claim 5, wherein each protuberance is a rib and the corresponding recess is defined by two spaced ribs.

* * * * *

UNITED STATES PATENT AND TRADEMARK OFFICE

CERTIFICATE OF CORRECTION

PATENT NO. : 4,450,624

DATED : May 29, 1984

INVENTOR(S) : John C. Collier

It is certified that error appears in the above-identified patent and that said Letters Patent is hereby corrected as shown below:

Column 1, line 8, after "and" add --,--

Claim 7, Column 4, line 24, after "wherein" add --the or--

Signed and Sealed this

*Eleventh* Day of *December 1984*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,450,624

DATED : May 29, 1984

INVENTOR(S) : John C. Collier

It is certified that error appears in the above-identified patent and that said Letters Patent is hereby corrected as shown below:

Column 1, line 18, after "and" add --,--

Claim 7, Column 4, line 24, after "wherein" add --the or--

This certificate supersedes certificate of correction issued Dec. 11, 1984.

Signed and Sealed this

*Twenty-second* Day of *October 1985*

[SEAL]

*Attest:*

*Attesting Officer*

DONALD J. QUIGG

*Commissioner of Patents and Trademarks—Designate*